United States Patent [19]

Dunn

[11] Patent Number: 4,458,469

[45] Date of Patent: Jul. 10, 1984

[54] CONTAINER WITH VACUUM ACCOMMODATING END

[75] Inventor: Martin T. Dunn, Hartsville, S.C.

[73] Assignee: Sonoco Products Company, Hartsville, S.C.

[21] Appl. No.: 488,324

[22] Filed: Apr. 25, 1983

[51] Int. Cl.[3] ..... B65B 7/28; B21D 53/00; B65D 8/12

[52] U.S. Cl. ..... 53/432; 53/440; 53/471; 53/487; 72/379; 220/66; 413/8

[58] Field of Search ..... 220/66, 67, 70; 215/262; 426/111, 118, 395, 404, 397; 53/432, 434, 440, 487, 471; 413/8, 56; 72/379

[56] References Cited

U.S. PATENT DOCUMENTS

| | | | |
|---|---|---|---|
| 1,987,817 | 1/1935 | Burns | 220/66 |
| 2,894,844 | 7/1959 | Shakman | 220/66 X |
| 3,105,765 | 10/1963 | Creegan | 220/66 X |
| 3,152,711 | 10/1964 | Mumford et al. | 220/66 X |
| 3,160,302 | 12/1964 | Chaplin | 220/66 X |
| 3,369,689 | 2/1968 | Dodge | 215/262 |
| 3,736,899 | 6/1973 | Manske | 220/DIG. 16 X |
| 4,286,745 | 9/1981 | Fukuoka | 220/66 X |

FOREIGN PATENT DOCUMENTS

| | | | |
|---|---|---|---|
| 2835638 | 2/1980 | Fed. Rep. of Germany | 220/306 |

*Primary Examiner*—Allan N. Shoap

*Attorney, Agent, or Firm*—Dennison, Meserole, Pollack & Scheiner

[57] ABSTRACT

In a container for accommodating hot liquid fills, an end closure capable of inward deflection in response to a decrease in internal pressure created by thermal contraction as the liquid fill cools. The closure is formed of conventional metal stock and includes, as formed, a central portion domed to define either a concave configuration or a convex configuration as viewed from the exterior of the container. The domed portion, as a step or steps prior to filling, is predeflected, either once or twice depending upon its initial configuration, to arrive at an outwardly domed configuration preparatory to inward deflection in response to the cooling of the product and for the accommodation of an internally generated vacuum.

11 Claims, 7 Drawing Figures

CONTAINER WITH VACUUM ACCOMMODATING END

BACKGROUND OF THE INVENTION

The invention is concerned with maintaining container integrity when subjected to an internal vacuum or negative pressure generated by the cooling of hot fill flowable material, particularly fruit juices and the like which, upon cooling, contract substantially, and to a degree which may distort the container and adversely affect the hermetic sealing thereof. This problem is particularly significant in composite containers, those containers wherein the body is formed of multiple plies of paper, paperboard, or the like.

Various procedures have been put forth for accommodating internally generated vacuums without affecting the appearance or integrity of the container. A particularly prevalent procedure calls for utilization of a metal end cap provided with a central section capable of inwardly deflecting in response to an internal vacuum. However, in order to provide a cap which will respond in this manner, it has heretofore been necessary to use metal ends of substantially less strength than those of the conventional, and preferred, tinplate or steel end. For example, in instances wherein deflection of the end is desired, resort is frequently had either to aluminum, which is significantly more expensive, and/or extremely thin constructions which give rise to problems with regard to the integrity and strength of the seams. Such problems include difficulties encountered in obtaining an airtight peripheral seam between the end and a composite container body, a reduction in the container-rigidifying capability of the end, and a substantial limitation on the depth to which the cap can be inwardly depressed to accommodate a negative pressure. Examples of such vacuum responsive ends will be noted in the following patents:

W. E. Burns U.S. Pat. No. 1,987,817 issued Jan. 15, 1935

R. M. Creegan U.S. Pat. No. 3,105,769 issued Oct. 1, 1963

G. F. Chaplin U.S. Pat. No. 3,160,302 issued Dec. 8, 1964

As an alternative to the use of excessively thin or prohibitively expensive end-forming metals, the patent to Fukuoka, No. 4,286,745, issued Sept. 1, 1981, suggests use of conventional tinplate which, as previously indicated, would not normally be responsive to or capable of optimal inwardly depression in response to negative pressure generated within the container. In appreciation of this, Fukuoka proposes a positive inward urging of the bulged end, by a press or the like, prior to a lowering of the temperature of the contents of the container and without recourse to the negative pressure generated. Such a procedure would have to be provided for immediately subsequent to the filling operation as an additional step by those charged with the filling of the containers. This is contrary to the preferred system whereby the container manufacturer presents the user with containers capable of use in a conventional filling operation and without recourse to additional manipulative steps.

SUMMARY OF THE INVENTION

The present invention proposes a system for the accommodation of an internally generated vacuum in a tubular container having a body, preferably of composite construction to take advantage of the particular economies associated therewith, and metal end closures of conventional material, thickness and weight.

Composite containers, well known as an economical substitute for the more expensive metal and glass containers, have generally been considered less than completely satisfactory for accommodating hot fillings, such as juices or the like wherein, upon the cooling of the product within the sealed container, substantial internal negative pressures are generated. Such pressures, in turn, give rise to problems with regard to the integrity of the container. Attempts to overcome these problems have included the use of thin readily flexed caps, the provision of expansion seams within the inner liner of the container, and reliance on external mechanical means to inwardly flex a cap subsequent to the filling of the container and prior to cooling. However, all of these known methods also incorporate inherent problems.

The system of the present invention is unique in providing for the utilization of a composite container, with opposed metal end caps, wherein the container body can be of conventional multi-ply paperboard construction, and wherein the closure ends are metal and of conventional thickness and weight. In this manner, all of the desirable features normally arising from the use of conventional metal ends, such as a rigidification and strengthening of the composite container and the like, are achieved. Further, inasmuch as a closure of conventional thickness is utilized, a proper and positive hermetic sealing of the end of the composite body is easily affected.

A metal end of conventional thickness and weight, while incorporating substantial advantages, will not, under normal circumstances, properly flex under an internally generated negative pressure. To the contrary, it is much more likely that the composite body, or liner thereof, will, at some point, destruct prior to an effective flexing of the metal end. To avoid this problem, as noted in the previously cited Fukuoka patent, it has been proposed to mechanically flex an end panel subsequent to the filling of the container and prior to a cooling of the contents thereof.

The present invention teaches the use of an end closure of conventional thickness and weight, normally using tinplate or steel as opposed to more expensive aluminum, wherein the end closure, incorporates a generally concavo-convex dome, which, during the container manufacturing procedure and prior to shipment to the food processor, is predeflected. This predeflection occurs either once or twice, depending upon the manufactured configuration of the end, to achieve an outwardly domed configuration prior to the filling of the container.

Predeflection is a significant aspect of the invention in that once the end has been subjected to predeflection, it has been found that the end becomes readily responsive to normal internally generated pressures. This is the case notwithstanding the basic conventional nature of the end closure, that is the use of tinplate or steel, as preferred for economic reasons, and the utilization of a standard thickness and strength for all of the advantages derived therefrom.

The predeflection of the domed central portion of the end closure need only be effected one time to insure a positive vacuum-induced response which is predictable and which provides for a significant inward draw into the interior of the container sufficient to avoid any detrimental effect on the composite body, including liner blisters, seam disruption, and the like.

Basically, the end closure of the invention is manufactured with a depressed or inward concave central bulge. The closure will be seamed to one end of a container body and subjected to a force, such as a blast of air, which predeflects the concave domed portion outward to define an outward convex configuration. This predeflection conditions the end for response to an internally generated vacuum. Accordingly, the container, after the initial predeflecting of the domed portion, is now ready to receive hot juices or the like and a second end closure, which may or may not incorporate a predeflected dome. The filling of the container and the application of the second end or end closure is effected in a conventional manner utilizing conventional apparatus. There is no necessity for the canner to revise his procedures or modify his apparatus. The outwardly domed end is automatically drawn inward in response to the reduced internal atmosphere generated by the cooling of the contents.

As an alternative to the manufacture of the closure with a inwardly domed or concave central portion which is predeflected outward, the closure can initially be configured with an outwardly domed or convex central portion which is subsequently predeflected inward and then outward, a two step procedure which conditions the end for subsequent automatic response to an internally developed vacuum.

Additional objects and advantages may become apparent from the details of construction and procedures as more fully hereinafter described and claimed.

DESCRIPTION OF PREFERRED EMBODIMENTS

Figure 1:
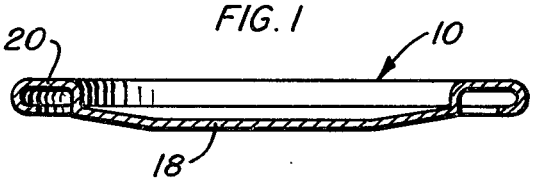
FIG. 1 is a cross-sectional view through a container closure manufactured in accordance with the present invention and prior to seaming to a container body.
Figure 2:
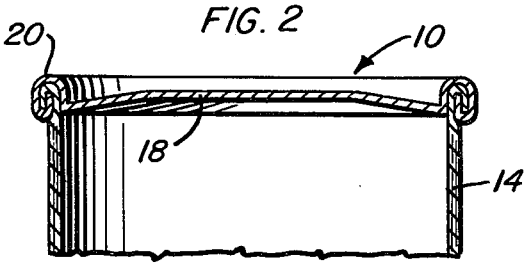
FIG. 2 is a cross-sectional view through an end portion of a container with the closure of FIG. 1 seamed thereto and with the domed central portion predeflected.
Figure 3:
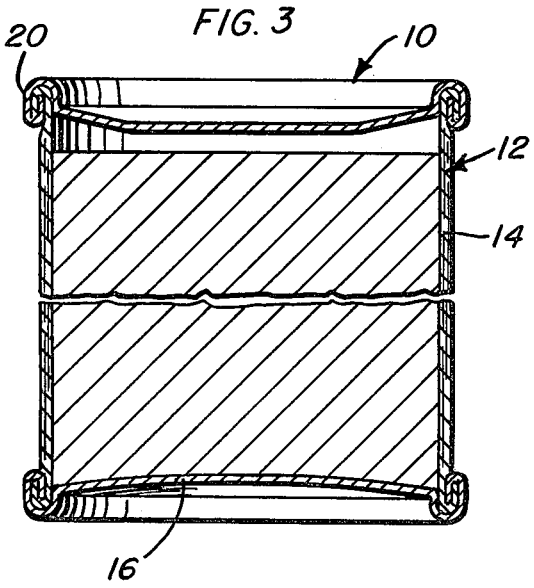
FIG. 3 is a cross-sectional view, with a portion broken away, of a product-filled container with the upper closure inwardly deflected in response to an internally generated vacuum.
Figure 4:
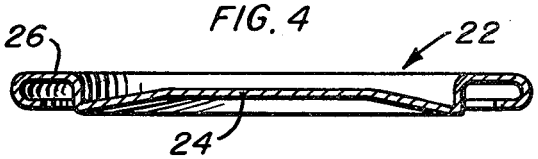
FIG. 4 is a cross-sectional view through another embodiment of container closure.

Referring now more specifically to the drawings, reference numeral 10 designates a cover or closure formed in accordance with the present invention. FIGS. 1, 2 and 3 illustrate the sequential steps in the distinctive manner of manipulation of the cover from its initial configuration to its final configuration on a filled and sealed container 12. The container 12, in addition to the closure 10, will include a tubular body 14, preferably formed of multiple spiral plies of paperboard to define a composite construction, and a second end cover 16.

The closure 10 is to be responsive to internally developed negative pressures, such as arise from the cooling of hot filled juices or the like. It is considered essential that provision be made for the accommodation of such negative pressures to avoid imploding or tearing of the container wall, a particularly serious problem when utilizing composite containers which are hermetically sealed. Various solutions have been proposed wherein the accommodation of the pressure differential is achieved by an inward deflecting or depressing of the central portion of one or both end closures. However, in those instances wherein the inward flexing of the cover is effected in response to the generated negative pressure, it has been necessary to utilize closures formed of thin highly flexible metals, normally aluminum. This, in turn, gives rise to several problems, including substantial additional costs and difficulty in achieving a proper seam with composite bodies.

The expense and problems associated with highly flexible covers, of aluminum or the like, is avoided by the present invention wherein the proposed closure is formed of the preferred tinplate or steel of a thickness and weight conventional in closures chosen for their structural integrity and ability to effectively seam to the container body. Such closures, for example of 75 pound metal, are normally incapable of a vacuum induced inward flexing, in the environment of this invention, even assuming a properly domed configuration is provided. Rather, the only suggestion of the use of such conventional material closures with a composite body wall wherein steps are to be taken to accommodate an internal vacuum, involves a physical inward pressing, through the use of an external press, after a filling of the container and prior to the cooling of the contents thereof. Such a physical inward pressing of the cover is effected against the internal pressure of the heated juices or the like and not in response to the subsequent cooling. As such, there is no direct relation between the internally generated vacuum and the degree of inward deflection of the cover.

The vacuum level developed in conventional metal cans, as well as composite containers, that is containers with tubular multi-ply paperboard bodies and metal end caps, is normally in the range of 12 or more inches Hg after a conventional hot filling and cooling cycle. This vacuum level will vary with the fill temperature, fill volume or head space.

A metal lid of conventional weight and outwardly domed for inward deflection to accommodate an internal vacuum, will normally require a minimum 20 inches Hg or more to effect the desired inward deflection. While this can be easily effected by an external press, such a force is substantially beyond that which can be generated through a conventional hot filling and cooling operation and which can be sustained by a composite body in particular. As such, it can be anticipated that damage to the body wall of the container will result in the absence of any pressure relief derived from the closure.

The present invention provides a unique procedure for a closure of conventional weight and material, such as tinplate or steel, to respond to an internal pressure below that capable of adversely affecting a composite body. Basically, the invention involves either a single or a two-step predeflection of the domed central portion of the cover.

The preferred embodiment of the invention is presented in FIGS. 1, 2, and 3. The closure 10 therein, noting FIG. 1, includes inner and outer faces and is manufactured with an inwardly domed central portion 18 surrounded by an annular seaming flange 20. The flange 20 is adapted for leak proof seaming with the upper edge portion of a conventional composite container tubular body. The seaming operation is performed in a conventional manner and, as a full weight and strength closure 10 is used, there is no difficulty in defining a seam with the strength and integrity required for a hermetically container.

FIG. 2 illustrates the closure 10 seamed to a tubular body 14 with the inwardly domed central portion 18 outwardly predeflected. This can be effected by an outwardly directed force which, as a matter of convenience, can be a blast of air introduced through the opposite end of the body 14. Alternatively, the domed portion 18 can be predeflected prior to mounting on the body 14. The open ended container, at this point, is basically completed and ready for shipment to those involved with the actual filling thereof. However, rather than requiring the generation of an internal vacuum of approximately 20 inches Hg, clearly beyond that generated by the cooling of hot filled juices and the like, and beyond that which can be sustained by a composite container, the domed portion 18 will inwardly deflect upon the generation of an internal negative pressure of approximately 10 inches Hg or less. The actual procedure followed by the filler basically involves a hot filling of the container through the open end thereof and a subsequent application of an appropriate closure or end panel 16 to the open end. This is followed by a cooling cycle during which the internal vacuum is generated. While not specifically described, it is to be recognized that the second closure or end panel 16 may be a predeflected domed duplicate of the cover 10, or may be a conventional non-flexing cover.

It will be appreciated that the embodiment of FIGS. 1–3 involves a method wherein the closure 10 is manufactured in a configuration approximating the configuration of the closure in a completed cooled package, the single step predeflection, as illustrated in FIG. 2, moves the domed portion to an intermediate position preparatory to return to its initial position of FIGS. 1 and 3.

Figure 5:
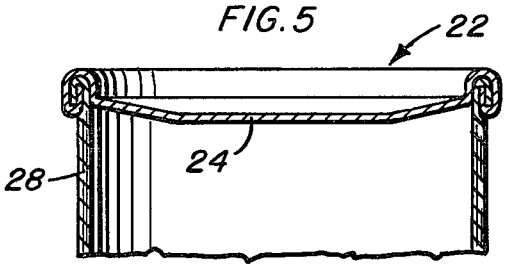
FIG. 5 is a cross-sectional view through the upper portion of a container with the closure of FIG. 4 seamed thereto and inwardly predeflected.
Figure 6:
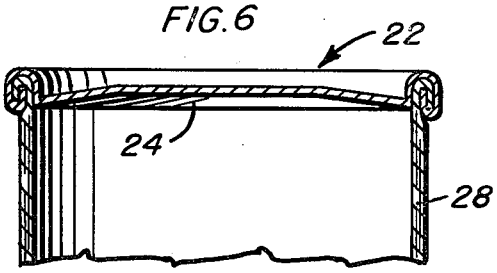
FIG. 6 is a view similar to FIG. 5 wherein the closure has been outwardly predeflected.
Figure 7:
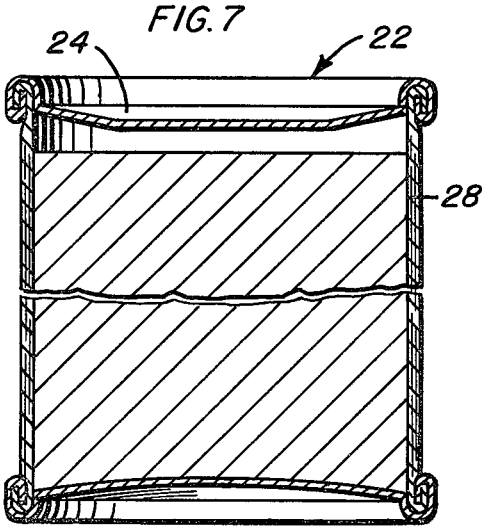
FIG. 7 is a cross-sectional view through a product-filled container, with a portion broken away, wherein the closure has been inwardly deflected in response to an internally generated vacuum.

The embodiment or procedural system of FIGS. 4, 5, 6 and 7 differs from the initially described embodiment in that the closure, herein designated by reference numeral 22, again manufactured of conventional weight closure metal such as tinplate or steel, includes, as manufactured, an outwardly domed central portion 24. This central portion 24, normally subsequent to the seaming of the peripheral flange 26 of the closure 22 to the end of a container body 28, is subjected to a two-stage predeflection. The domed portion 24, as illustrated in FIG. 5, is initially predeflected inward by any appropriate means such as a press or the like. This inward predeflection is followed by a second outward predeflection, noting FIG. 6, which, as with the first described system, may be effected by a blast of air through the open end of the container body 28. At this point, the open ended container is ready for hot filling with the outwardly domed cover 22, subsequent to the two-stage predeflection, easily inwardly deflecting, upon the generation of an internal pressure of approximately 10 inches Hg or less. This, again, is substantially less than the 20 inch Hg required for an initial deflection of the domed central portion of a conventional heavy metal end of tinplate or steel.

While predeflection is described supra as occurring after a seaming of the closure to the container body, such predeflection can, as desired, occur prior to the mounting of the closure of the body.

Advantages of the invention, as previously discussed, include the possibility of using closures or end panels of greater strength. This substantially enhances the structural stability of composite containers in particular and at the same time provides for seaming flanges of sufficient strength to ensure a proper sealed seam. It has also been found that the predeflection of the metal closures enables a more consistent and deeper drawing of the domed portion into the interior of the container. Thus, the internal vacuum is more completely accommodated and there is substantially less tendency to disrupt the integrity of the container itself.

In each of the above described embodiments, it is to be appreciated that a significant feature of the invention is the predeflection of the domed central portion of the closure or cover. It is this predeflection which conditions the closure, notwithstanding the relatively greater strength or stiffness thereof, to accommodate itself to an internal negative pressure in a manner heretofore not thought possible.

While predeflection in accordance with the present invention has been set forth as being particularly significant with regard to heavier metals such as steel or tinplate, it is to be recognized that predeflection can also be used as a means for enhancing the ability of conventional pressure response closures, for example of aluminum or the like, to inwardly deflect in response to an internal pressure drop. In such cases, predeflection assures both a proper inward drawing of the domed portion and a deeper draw than would otherwise be available were the initial deflection of the closure occurring in response to the product generated vacuum.

The foregoing is illustrative of the principals of the invention. As other embodiments and modifications may occur to those skilled in the art, it is not desired to limit the invention to the exact construction and operation herein shown and described. Rather, all suitable modifications and equivalents are to be considered within the scope of the invention.

I claim:

1. A method of providing an end closure for a sealed container adapted to accommodate an internally generated negative pressure atmosphere in the sealed container, said method comprising the steps of forming a metal closure with a peripheral mounting flange and a central dome, said closure being adapted for mounting on and closing one end of a container body, said closure having opposed inner and outer faces, said dome, when formed, projecting outwardly relative to one of said faces, forcibly predeflecting said dome for projection outward relative to the opposed face, said predeflecting of said dome relative to the opposed faces being effected prior to sealing the container and at least once and continuing until said dome is positioned to project outward relative to the outer face of the metal closure preparatory for inward deflection in response to a negative pressure internally generated in the sealed container incorporating said closure.

2. The method of claim 1 wherein said closure is formed with said dome projecting outwardly relative to said inner face.

3. The method of claim 2 wherein said dome is predeflected one time.

4. The method of claim 1 wherein said closure is formed with said dome projecting outward relative to said outer face.

5. The method of claim 4 wherein said dome is predeflected twice.

6. A method of conditioning a vacuum-responsive closure for a container, said closure having inner and outer faces and incorporating a central domed portion adapted for movement when said closure is mounted in sealed relation to one end of a container body and subjected to a reduced pressure within the container subsequent to a sealing of the other end of the container body, said closure being capable of deflection between one position projecting outward relative to said outer face and another position projecting inward relative to said inner face, said method comprising predeflecting the domed portion between the two positions prior to sealing of the other end of the container body and prior to subjection of the closure to a reduced pressure generated within the container, the final predeflecting of said domed portion positioning said domed portion projecting outward relative to said outer face.

7. The method of claim 6 wherein said domed portion, subsequent to the predeflection thereof, is subjected to a negative pressure within the container, said domed portion deflecting inward, in response to the negative pressure, relative to the inner face and into the interior of the container.

8. The method of claim 7 wherein said closure is mounted in sealed relation to a container body prior to predeflection of the domed portion.

9. A method of forming a closed product-containing container comprising the steps of providing an air impervious body, forming a metal end closure for said body with a peripheral seaming flange and a central generally concavo-convex dome, said closure having opposed inner and outer faces with the dome projecting outward of one of said faces, seaming the peripheral seaming flange of the metal closure to one end of the body with the inner face inwardly directed toward the interior of the body, predeflecting said dome to alternatively project outward of the other face at least once and continuing until said dome projects outwardly relative to the container body, hot filling the container body, seaming a second end closure to the second end of the container body, and cooling the container at least until an inward deflection of the dome is effected in response to an internally generated reduced pressure.

10. A method of forming a closed product-containing container comprising the steps of providing an air impervious body, forming a metal end closure for said body with a peripheral seaming flange and a central generally concavo-convex dome, said closure having opposed inner and outer faces with the dome projecting outward of one of said faces, predeflecting said dome to alternatively project outward of the other face at least once and continuing until said dome projects outwardly relative to the outer face, seaming the peripheral seaming flange of the metal closure to one end of the body with the inner face inwardly directed toward the interior of the body, hot filling the container body, seaming a second end closure to the second end of the container body, and cooling the container at least until an inward deflection of the dome is effected in response to an internally generated reduced pressure.

11. In a method of forming a product-receiving container including the steps of providing a container body with opposed ends, forming a closure with a central domed area adapted for deflecture relative to the interior of the container in response to pressure generated therein, and sealing the closure to one end of the body preparatory to filling the body and closing the opposed end, the improvement comprising physically predeflecting the central domed area of the closure subsequent to a forming thereof and prior to a filling of the container to enhance the responsiveness to interiorly generated pressure, said predeflection positioning the domed area to project outward relative to the body when sealed to the closure.

* * * * *